United States Patent [19]

Howarth, Jr.

[11] 4,150,681

[45] Apr. 24, 1979

[54] VISOR MOUNTED WASHER FOR GOGGLES

[76] Inventor: William F. Howarth, Jr., 8 E. Dracut St., Methuen, Mass. 01844

[21] Appl. No.: 895,938

[22] Filed: Apr. 13, 1978

[51] Int. Cl.[2] ..... B08B 3/02

[52] U.S. Cl. ..... 134/172; 2/438; 15/250.01; 239/284 R; 280/289 R; 296/78.1

[58] Field of Search ..... 2/435, 438; 239/284 R, 239/284 A; 134/94, 102, 115 R, 123, 172, 198, 201; 296/78.1; 280/289 R; 15/250, 250.01

[56] References Cited

U.S. PATENT DOCUMENTS

| | | | |
|---|---|---|---|
| 2,187,117 | 1/1940 | Faulkner | 239/284 R X |
| 2,971,196 | 2/1961 | Howell | 2/438 |
| 3,117,727 | 1/1964 | Pollock et al. | 239/284 |
| 3,599,869 | 8/1971 | Oberdorfer | 134/123 UX |
| 3,605,766 | 9/1971 | Carlani, Jr. | 2/438 X |

FOREIGN PATENT DOCUMENTS

| | | | |
|---|---|---|---|
| 1046867 | 7/1953 | France | 280/289 R |

*Primary Examiner*—Robert L. Bleutge
*Attorney, Agent, or Firm*—Pearson & Pearson

[57] ABSTRACT

Washing apparatus for cleaning the lenses of goggles, worn by a motorcyclist during a muddy race, is mounted on the forward portion of a duck bill visor to jet spray cleaning liquid onto the goggles to clear the lenses of mud. An oval tank of cleaning liquid is pressurized with air and supported on the front fork of the cycle, there being a flexible tube extending from the tank, up the sleeve of the rider and thence along the helmet to the jet spray on the visor. A finger actuated control valve and a breakaway are incorporated into the tube.

8 Claims, 3 Drawing Figures

76
81
79
36
56
55
58
38
37
59
39
28
29
34
84
35
77
82
83
49
27
33
26
48
46
42
43
20
21
25
54
47
53
41
76
32
78

55
56
59
57
76
62
75
64
74
68
72
69
66
71
76
61
65
63
58
67

61
76
81
79
56
36
55
57
58
59
37

20
76
82
33
83
87
86
31
28
34
35
85
29
77
26
32
27
78
41
49
48
42
53
51
45
52
44
54
43
23
24
21
22

VISOR MOUNTED WASHER FOR GOGGLES

BACKGROUND OF THE INVENTION

In motorcycle races especially when the going is muddy or dusty the conventional goggles, or transparent face mask on the mandatory helmet quickly become obscured so that they must be repeatedly cleaned or there is a strong temptation for the motorcyclist to remove the goggles or face mask permanently thus risking eye damage.

One solution sometimes used is to provide multiple layers of transparent plastic such as acetate, over the lenses of the goggles, so that individual and successive layers can be stripped off to uncover clean surfaces.

Liquid curtain shower pipes have been incorporated into the upper frame of goggles to clean the lenses when a bulb is pressed as in U.S. Pat. No. 1,354,433 to DeFelice of Sept. 28, 1920.

A similar set of goggles with attached washing means is disclosed in U.S. Pat. No. 2,971,196 to Howell of Feb. 14, 1961 wherein pressure is obtained from an air bladder mounted on the back of a rider and controlled by a valve held in the hand.

One disadvantage of a helmet-carried tank, or a back carried liquid supply, is that it adds unduly to the weight carried by the rider, thus being especially inconvenient in the slippery muddy environment and high speed travel encountered by a motorcycle racer.

SUMMARY OF THIS INVENTION

In this invention a larger than usual source of cleaning liquid is provided, by means of a generally oval tank of inflexible sheet metal, removably mounted on the front of the fork of a motorcycle, so that its weight is carried by the cycle rather than on the rider.

Instead of attempting to make special, costly, motorcycle goggles with the built-in liquid curtain shower pipes and orifices, the goggles of the invention are of a commercially available, volume production inexpensive type and the liquid delivery means is mounted on a low cost, duck bill visor of plastic.

The oval tank includes a pneumatic valve to enable it to be pressurized with air from any convenient source to about fifteen to twenty pounds per square inch.

An adjustable plate and a plurality of slots in the forward portion of the duck-bill visor permit a jet spray nozzle, aimed at the lenses of the goggles, to be moved forwardly or rearwardly to the best advantage.

A hand, or finger, control, normally closed valve is included in a flexible tube connecting the tank to the nozzle, along the handlebar, up the sleeve of the rider, along the inside, or outside of the helmet.

A breakaway member is also included in the tube to separate the helmet and visor of the rider from the tank on the cycle without damage or strain, if, and when, the rider is dislodged from his seat or from the cycle.

DESCRIPTION OF A PREFERRED EMBODIMENT

Figure 1:
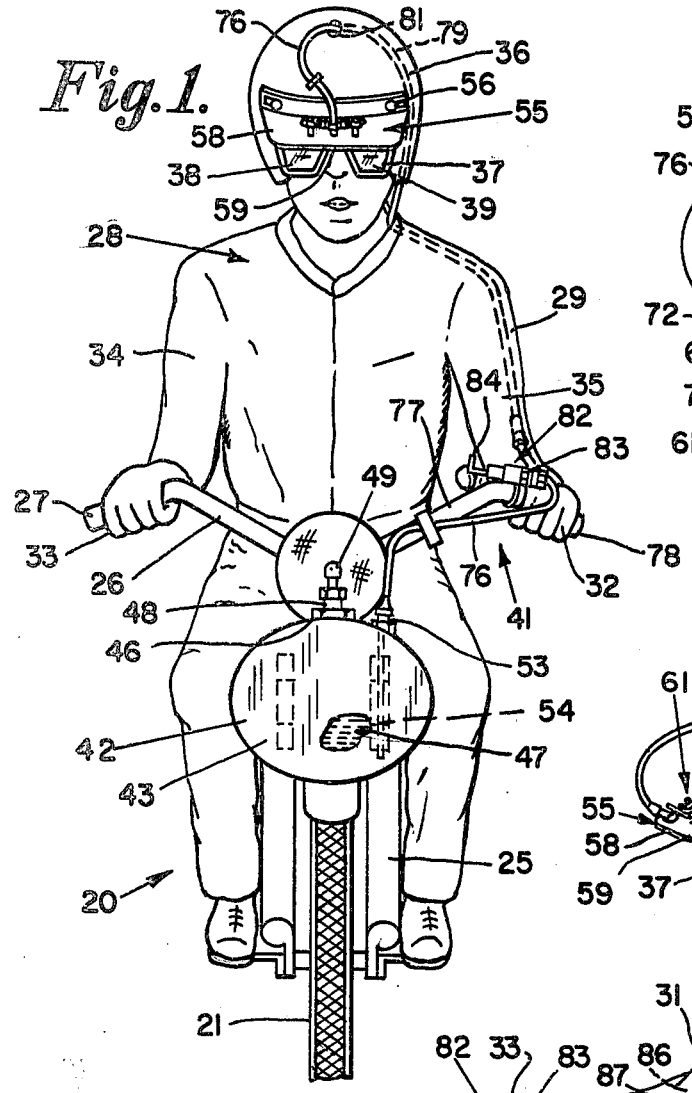
FIG. 1 is a front elevation of a motorcycle and helmeted rider showing the washer of the invention.
Figure 3:
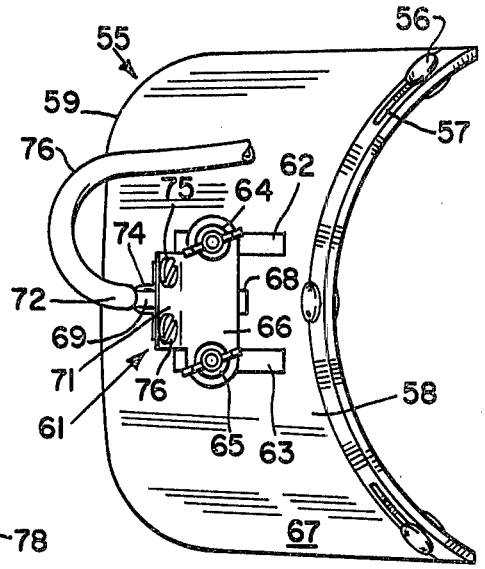
FIG. 3 is a fragmentary enlarged, top plan view of the liquid delivery means on the duck bill visor.
Figure 3:
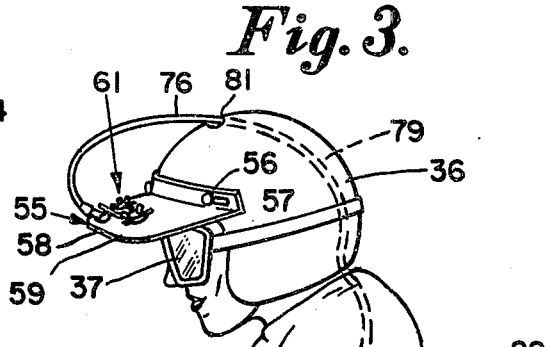
Figure 2:
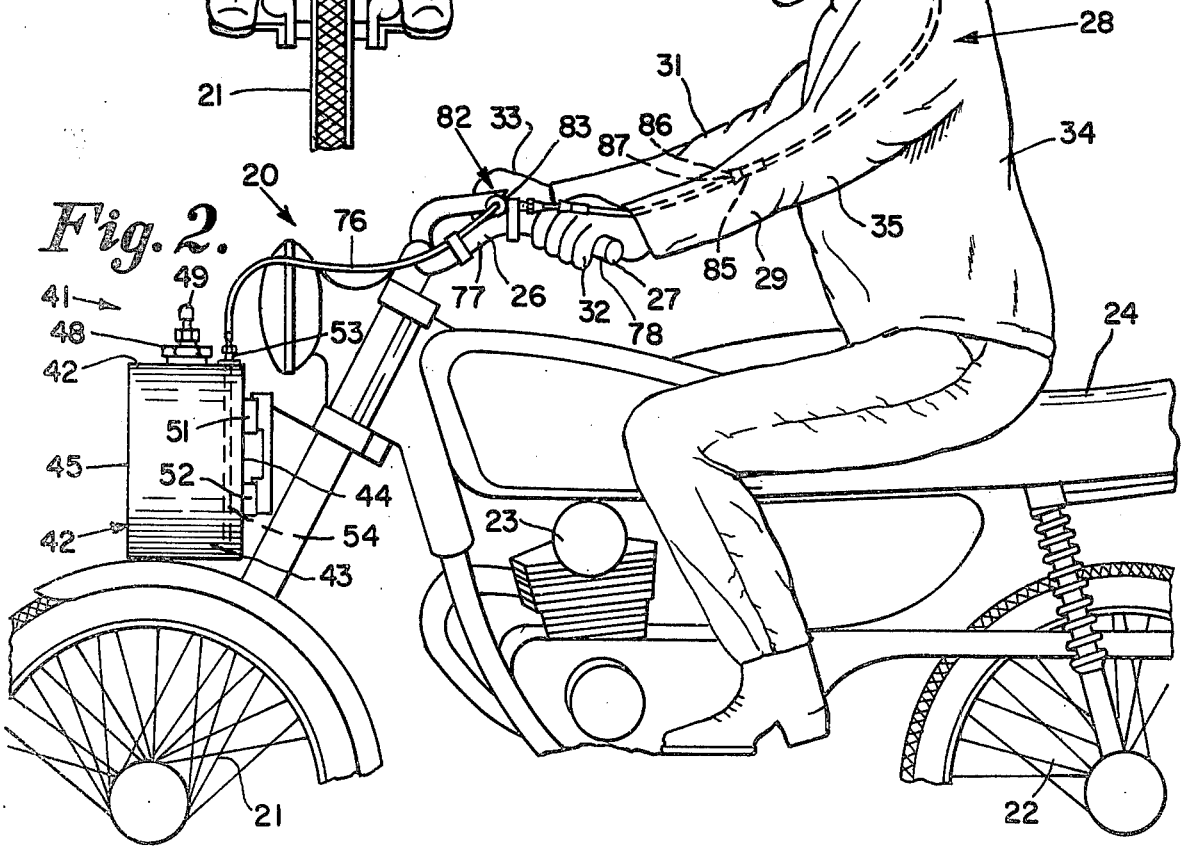
FIG. 2 is a side elevation thereof.

In the drawing, the motorcycle 20 includes the wheels 21 and 22, motor 23, seat 24, front fork 25, handlebars 26 and handlebar grips 27. The rider, or helmeted motorcyclist 28, has left arm 29, right arm 31, hands 32 and 33, a jacket 34 with sleeves 35, a helmet 36 and goggles 37 with lenses 38 and 39.

The washing apparatus 41 of the invention includes a tank 42, of relatively inflexible sheet metal 43 having a flat back wall 44 and a flat front wall 45 both of oval configuration to form an oval container with a top portion 46. Tank 42 is a pressure tank, filled with cleaning liquid 47, through the screw type filler cap 48 in the top portion 46 and having a pneumatic valve 49 such as a Schroeder valve by which the tank can be pressurized to fifteen to twenty pounds per square inch from any convenient air pressure source.

Tank 42 includes a pair of spaced brackets 51 and 52 by which it is removably attached to, and supported by, the front of the front fork 25 of the cycle 20, thus enabling a large volume of liquid 47 to be carried without burdening the rider 28. Tank 42 also includes a liquid outlet nipple 53 in the top portion 46 forming an effluent port for the air pressurized liquid in the tank, there being an internal tube 54 in the tank to feed the liquid from the inside bottom of the tank.

The rider 28 carries, preferably on his helmet 36, a duck bill visor 55, attached to the helmet by snap fasteners 56 in lateral slots 57 in the plastic 58 of the visor, so as to be readily detachable. The visor 55 projects forwardly from the helmet 36 for a substantial distance, such as three inches, to a forward portion 59 in front of, and above the goggles 37.

The cleaning liquid, delivery means 61, of the invention, is mounted centrally of the forward portion 59 of visor 55 and includes a pair of elongated slots 62 and 63 for the wing nuts and bolts 64 and 65 by which a transverse plate 66 is slidable on the upper face 67 of the visor 55 to desired locations.

A central elongated slot 68, between, and in parallelism with, the pair of outer slots 62 and 63 is provided in visor 55 for a jet spray nozzle 69 to project downwardly and rearwardly therethrough to direct a spray of cleaning liquid against each lens 38 and 39 of goggles 37, the nozzle 69 being supported by the upwardly inclined integral forward flange 71 of plate 66. The jet spray nozzle 69 is connected to a liquid inlet nipple 72, which moves with it on the transverse plate 66 and in the three parallel slots for threaded adjustment at the optimum location for spraying the goggles. A U shaped bracket 74, and machine screws 75 and 76 are provided to removably affix the nozzle 69 to the flange 71 and if desired the nozzle can be adjusted to direct the spray into the mouth of the rider rather than to clean the goggles 37.

An elongated, flexible tube 76, preferably of transparent plastic, connects the outlet nipple 53 of the tank 42 with the inlet nipple 72 of the jet spray nozzle 69, preferably being trained slong the left handlebar 77, past the left hand grip 78, then up the left sleeve 35 of the jacket 34, thence along the inside 79 of the helmet, thence out of a hole 81, easily drilled in the front thereof, and thence to the inlet nipple 72 on visor 55.

Valve means 82 in the form of a normally closed valve 83 having a finger grip control handle 84 is mounted intermediate of tube 76 so as to be easily actuated by the left hand 32 of the rider 28 without removing the hand from its handlebar grip. Thus the rider may selectively open the valve 83 to connect the tank 42 to the nozzle 69 and spray the goggles with cleaning liquid 47 whenever necessary or desired.

At least one breakaway element 85 is mounted intermediate of the length of tube 76, so as to pull apart under slight pull and enable the rider to be dislodged from the cycle without danger in case of a spill. The breakaway element may be merely one end 86 of a tube slidably removable from a flared end 87 of another tube. It is also useful as a separation means when the rider desires voluntarily to leave the motorcycle just prior to or after a race.

I claim:

1. Washing apparatus for selectively applying a jet of cleaning liquid to the lenses of a pair of goggles worn by the helmeted rider of a motorcycle during a race, said apparatus comprising:

a tank containing cleaning liquid, mounted on the front of the fork of said motorcycle, said tank having a filler cap and a liquid outlet nipple;

a duck bill visor mounted on said helmet and projecting forwardly therefrom to a substantial distance in front of, and above said goggles;

cleaning liquid delivery means mounted centrally of the forward portion of said duck bill visor, including a jet spray nozzle for directing cleaning liquid onto said lenses to wash the same and a liquid inlet nipple connected to said nozzle;

an elongated, flexible tube connecting the outlet nipple of said tank with the inlet nipple of said delivery means;

a source of pressure, for pressurizing the liquid in said tank;

and a normally closed valve intermediate of said, flexible tube, accessible to one hand of said rider, for selectively opening said valve to apply pressurized cleaning liquid from said visor onto said goggles.

2. Washing apparatus as specified in claim 1 wherein:

said tank is of rigid sheet metal, with a front and back wall of flat oval configuration and includes a pair of attachment brackets integral with said flat oval back wall.

3. Washing apparatus as specified in claim 1, wherein:

said tank is of rigid sheet metal and said filler cap includes a pneumatic valve for pressurizing said tank with air.

4. Washing apparatus as specified in claim 1 wherein:

said duck bill visor includes three spaced, parallel, slots, extending from proximate the front to proximate the rear thereof; and said cleaning liquid delivery means includes a plate supporting said jet spray nozzle;

said plate having nut set screws each on an opposite side thereof, tightenable in the two outside said slots;

to adjust the location of said nozzle.

5. Washing apparatus as specified in claim 1 wherein:

said elongated flexible tube includes at least one easily actuated, breakaway element, intermediate of the length thereof, whereby said tube will disconnect without harm to the rider, if the rider is dislodged from said motorcycle during a race.

6. Goggle washing apparatus for a racing motorcyclist, said apparatus comprising;

a pressure tank, mounted on the front of the fork of a motorcycle, and having a liquid filler cap, a pneumatic inlet valve and a liquid outlet nipple;

a duck bill visor, worn by the motorcyclist, and projecting forwardly from his head to a substantial distance in front of, and above his goggles;

cleaning liquid delivery means on said visor, including a jet spray nozzle in the forward portion thereof adapted to direct liquid on the lenses of said goggles and including a liquid inlet nipple;

an elongated flexible tube connecting the outlet nipple of said tank to the inlet nipple of said liquid delivery means; and valve means intermediate of the length of said tube for selectively controlling the application of pressurized cleaning liquid from said tank onto the lenses of said goggles.

7. Goggle washing apparatus as specified in claim 6 wherein:

said cleaning liquid delivery means includes adjustment mechanism for advancing and retracting the location of said jet spray nozzle on said visor relative to the lenses of said goggles to adjust the jet spray therefrom.

8. Goggle washing apparatus as specified in claim 6: plus a breakaway element, intermediate of said elongated flexible tube for parting said tube between said motorcycle and said motorcyclist if said motorcyclist is dislodged therefrom.

* * * * *